United States Patent [19]

Cook et al.

[11] 4,343,694

[45] Aug. 10, 1982

[54] MAGNETIC BENEFICIATION OF CLAYS UTILIZING MAGNETIC SEEDING AND FLOTATION

[75] Inventors: Jerry A. Cook, Tennille; Gary L. Cobb, Davisboro, both of Ga.

[73] Assignee: Anglo-American Clays Corporation, Sandersville, Ga.

[21] Appl. No.: 180,976

[22] Filed: Aug. 25, 1980

[51] Int. Cl.[3] ..... B03B 1/00

[52] U.S. Cl. ..... 209/9; 209/39; 209/166; 209/214

[58] Field of Search ..... 210/693, 703–705; 209/214, 3, 4, 5, 8–10, 18, 39, 40, 165–167

[56] References Cited

U.S. PATENT DOCUMENTS

| | | | |
|---|---|---|---|
| 3,806,449 | 4/1974 | Kaiser | 210/695 X |
| 3,974,067 | 8/1976 | Nott | 209/3 |
| 4,087,004 | 5/1978 | Nott et al. | 209/214 X |
| 4,125,460 | 11/1978 | Nott et al. | 209/214 X |

*Primary Examiner*—Thomas G. Wyse

*Attorney, Agent, or Firm*—Weingram & Klauber

[57] ABSTRACT

A method is disclosed for separating titaniferous and ferruginous discolorants from a crude kaolin clay. A dispersed aqueous slurry of the clay is formed containing a deflocculant and a fatty acid collecting agent, and the slurry is conditioned to coat the discolorants with the collecting agent to thereby render the discolorants hydrophobic. A system of sub-micron sized magnetic ferrite seeding particles, the surfaces of which have been rendered hydrophobic, is thereupon added to the slurry. The seeded slurry is mixed to coalesce the hydrophobic-surfaced discolorants with the hydrophobic-surfaced seeding particles, and the slurry is then subjected to a froth flotation, which removes substantial quantities of the discolorants and seeding particles coalesced therewith, and also removes excess seeding particles and excess collecting agent. The flotation-beneficiated slurry is then subjected to a magnetic separation by passing the slurry through a porous ferromagnetic matrix positioned in a magnetic field, having an intensity of at least 0.5 kilogauss, to remove further quantities of the discolorants and seeding particles associated therewith, and to remove seeding particles unassociated with said discolorants.

19 Claims, 6 Drawing Figures

MAGNETIC BENEFICIATION OF CLAYS UTILIZING MAGNETIC SEEDING AND FLOTATION

BACKGROUND OF INVENTION

This invention relates generally to methods for beneficiation of minerals, and more specifically, relates to a method for improving the brightness of kaolin clays through the use of synergistically related flotation and magnetic separation.

Naturally occurring kaolin clays frequently include discoloring contaminants in the forms of iron-based ("ferruginous") and titanium-based ("titaniferous") impurities. The quantities of the titaniferous discolorants are particularly significant in the case of the sedimentary kaolins of Georgia, where such impurities are commonly present as iron-stained anatase and rutile. In the case of various crude kaolin clays, it is accordingly often desired and indeed, frequently imperative, to refine the natural product in order to bring the brightness characteristics thereof to a level acceptable for paper coating and other applications. Various techniques have been used in the past to effect the removal of the aforementioned discolorants. Thus, for example, hydrosulfites have been widely used for converting at least part of the ferruginous discolorants to soluble forms, which may then be removed from the clays.

Among the most effective methods for removing titaniferous impurities, including, e.g., iron-stained anatase, are the well-known froth flotation techniques. According to such methods, an aqueous suspension or slurry of the clay is formed, the pH of the slurry is raised to an alkaline value, for example by the addition of ammonium hydroxide, and a collecting agent is added, as for example, oleic acid. The slurry is then conditioned by agitating same for a relatively sustained period. A frothing agent, such as pine oil, is then added to the conditioned slurry, after which air is passed through the slurry in a froth flotation cell to effect separation of the impurities.

The aforementioned flotation technology, however, becomes of decreasing effectiveness as one attempts to utilize same to remove smaller and smaller discolorant particles. The difficulty in this regard is that the flotation forces are insufficient with respect to such small particles to overcome drag forces; and hence, the particles cannot adequately respond to the flotation treatment.

Within recent years it has further been demonstrated that high intensity magnetic separation techniques may be utilized for removing certain of the aforementioned impurities, including titaniferous impurities, and certain ferruginous matter. Anatase, for example, and certain other paramagnetic minerals, have been found to respond to high intensity magnetic fields. Thus, for example, U.S. Pat. No. 3,471,011 to Joseph Iannicelli et al., discloses that clay slurries may be beneficiated by retention for a period of from about 30 seconds to 8 minutes in a magnetic field of 8,500 gauss or higher. Reference may also be made to U.S. Pat. No. 3,676,337, to Henry H. Kolm, disclosing a process for treating mineral slurries by passing same through a steel wool matrix in the presence of a background field of at least 12,000 gauss. Various apparatus, such as that disclosed in Marston, U.S. Pat. No. 3,627,678, may be utilized in carrying out the kolm processes. In this latter instance the slurry is thus passed through a canister, which contains a stainless steel or similar filamentary ferromagnetic matrix, while a high intensity magnetic field is impressed on the matrix by enveloping coils.

In certain further instances, as for example, in the teaching of U.S. Pat. No. 3,826,365, to V. Mercade, titaniferous impurities which are sought to be separated by a high-intensity magnetic field, are in advance of such separation, selectively flocculated. Somewhat similar phenomena are considered in Soviet Pat. No. 235,591 to Tikhanov, where several agents are used to selectively flocculate impurities in a slip of clay, which impurities are thereafter separated in a ferromagnetic filter including steel balls which have been previously rendered hydrophobic by treatment with a silicone compound.

All of the above magnetic separation methods, including those which employ differential flocculation, suffer from the limitation that particles with low magnetic susceptibility are not readily separated, despite the various technologies mentioned.

It may further be noted that in U.S. Pat. No. 3,974,067, to Alan J. Nott, which patent is assigned to the assignee of the present application, a method is disclosed for brightening a kaolin clay, wherein the clay as an aqueous dispersed slurry is subjected to a froth flotation treatment to remove titaniferous impurities, and the purified product from the froth flotation is thereupon subjected to magnetic separation by passing such product through a slurry-pervious ferromagnetic matrix positioned in a high intensity magnetic field. This method, while very effective compared to many prior art techniques, still retains certain of the limitations discussed in connection with flotation and conventional magnetic separation, i.e., small particle sized discolorants are floated only with difficulty, and particles of very low magnetic susceptibility cannot ultimately be removed by the magnetic separator stage of the process.

In a series of recent United States patents assigned to the assignee of the present application, a method has been disclosed for vastly increasing the effectiveness of magnetic separation methodology as same is applied to various minerals, including kaolin clays. In the techniques set forth in these patents, which include Nott et al U.S. Pat. Nos. 4,087,004, and 4,125,460, a dispersed aqueous slurry of the clay to be treated, is mixed with a finely divided magnetic particulate based upon magnetic ferrite particles. The slurry is thereupon passed through the aforementioned porous ferromagnetic matrix in the presence of an applied magnetic field, whereby contaminants seeded by the particulate are separated by the slurry. The said techniques are so effective that it is possible to obtain a high degree of brightening even with very low intensity applied fields. U.S. Pat. No. 4,125,460 indeed discloses achieving of fully acceptable brightening at field intensities as low as 0.5 kilogauss.

Further pertinent art is disclosed in Shubert, U.S. Pat. No. 3,926,789, which teaches the selective separation of minerals by use of ferrofluids. In particular the ferrofluid is used to selectively wet a mineral component sought to be separated from a mineral mixture. In consequence the selected component is rendered of increased magnetic susceptibility, and is able to respond and be captured in the magnetic separator through which the mineral mixture is then passed.

Despite the fact that very minute discolorant particles can often not be recovered by the method, for aforementioned magnetic seeding methodology as disclosed in the Nott et al U.S. Pat. Nos. 4,087,004 and 4,125,460 above mentioned, has been among the most effective techniques thus far found to remove titaniferous and feruginous discolorants. Certain practical difficulties, however, are presented by commercial scale use of the said seeding technology. A principal one of these is that use of the magnetic seeding materials tends to produce relatively rapid fouling and blinding of the porous ferromagnetic matrix.

In particular, the magnetic separating apparatus which are most commonly utilized in the kaolin and other minerals processing industries, and which are generally of the type disclosed in the aforementioned U.S. Pat. No. 3,676,337, employ, as already mentioned, a matrix comprising fine steel wool. The magnetic ferrites (such as ferroso-ferric oxide) which are used as the magnetic seed, are of course, removed at the steel wool matrix during passage of the seeded slurry through the said matrix. In the usual procedures for utilizing these magnetic separators, the matrix is periodically flushed with the magnetic field extinguished, i.e., in order to remove and flush the discolorant materials and magnetic seed which have become accumulated in the matrix. In conventional magnetic separation technology, these flushing operations are highly effective, and the said apparatus can operate for months without any requirement for completely disassembling the apparatus for removal for thorough cleaning or replacement of the steel wool.

Magnetic ferrite particles, as for example the aforementioned ferroso-ferric oxide, have, however, a degree of residual magnetism. In consequence they are not easily flushed from the steel wool matrix, i.e., flushed during the normal flushing operations which occur in situ. In consequence, fouling and blinding of the steel wool matrices can occur with rapidity, necessitating relatively frequent disassembling of the separator apparatus and replacement or separate cleaning of the fouled matrix.

It may further be pointed out that certain of the magnetic seeding compositions include liquid organics. These materials can similarly accumulate in the matrix and cause contamination and fouling of same. In addition, certain of the organics, as for example, fatty acids which can be present with various ferrofluids, even if such compounds do not excessively foul the matrix, remain in the beneficiated output from the separator. Where such output is a coating clay, the said compounds can add highly undesirable properties. Oleic acid, for example, will introduce an undesirable frothiness into the coating clay, which will render same relatively unsuitable for most coating applications.

In accordance with the foregoing, it may be regarded as an object of the present invention, to provide a method for magnetically beneficiating clays by utilizing as one aspect thereof, magnetic seeding, which method removes discoloring titaniferous and ferruginous discolorants, to enable brightness improvements previously unattainable through prior art techniques based upon flotation, magnetic separation, or prior known combinations of same.

It is a further object of the present invention, to provide a method for magnetically beneficiating kaolin clays, which is so highly effective in removing titaniferous and iron-containing discolorants, as to enable production of coating quality clays from crudes previously deemed too contaminated for such ultimate use.

It is a still further object of the present invention, to provide a method as aforementioned, which is based upon use of magnetic seeding materials, and which method may be practiced utilizing conventional porous matrix magnetic separators, without rapidly fouling or blinding the said matrices.

It is a yet further object of the invention, to provide a method for magnetically beneficiating kaolin clays, which method employs magnetic seeding materials which are produceable at low cost, which are highly stable and storeable, and which therefore, are admirably suitable for commercial scale operations.

SUMMARY OF INVENTION

Now in accordance with the present invention, the foregoing objects, and others as will become apparent in the course of the ensuing specification, are achieved in a method which synergistically integrates the processes of magnetic separation of seeded discolorants and froth flotation of clays, which processes were previously deemed distinct, so as to enable results previously unachievable by the individual processes, or by prior known combinations of same.

In accordance with the present invention, titaniferous and ferruginous discolorants are separated from a crude kaolin clay, by forming a dispersed aqueous slurry of the clay containing a deflocculant, and a fatty acid collecting agent. The slurry is thereupon conditioned in the presence of at least 0.25 lb/ton dry of the collecting agent (which more typically can be present as from about 1 to 4 lbs/ton of dry clay) to coat the discolorants with the collecting agent, and thereby render the discolorants hydrophobic. The slurry is thereupon seeded with a system of sub-micron sized magnetic ferrite seeding particles, the surfaces of which have been rendered hydrophobic, after which the seeded slurry is mixed to coalesce the hydrophobic-surfaced discolorants with the hydrophobic-surfaced seeding particles. The seeded slurry is thereupon subjected to a froth flotation to remove substantial quantities of the discolorants and seeding particles coalesced with same, and to remove excess seeding particles and excess collecting agent. Thereupon, the flotationbeneficiated slurry is subjected to a magnetic separation to remove further quantities of the discolorants and seeding particles associated therewith, and to remove seeding particles unassociated with the discolorants. The magnetic separation may be effected by passing the slurry through a porous ferromagnetic matrix whereat a field intensity of at least 0.5 kilogauss is maintained.

In a presently preferred embodiment of the invention, the magnetic seeding system may comprise magnetic ferrite particles in an aqueous phase, together with a fatty acid containing from 10 to 15 carbon atoms, the acid rendering the ferrite particles hydrophobic and serving to size-stabilize same.

The fatty acid should be present in the seeding system in concentrations of at least $6.7\times10^{-3}$ g-moles per lb. of magnetic ferrite expressed as $Fe_3O_4$, with a typical concentration of the said fatty acid being of the order of $3.8\times10^{-2}$ g-moles per lb. of the said ferrite. Because of its ready availability and low cost, dodecanoic acid is an especially attractive fatty acid for use in the foregoing seeding system.

In a further aspect of the invention, the seeding system may comprise magnetic ferrite particles in an organic liquid phase containing a fatty acid which will render the ferrite particle surfaces organophilac. The organic liquid in such a system may, for example, be kerosene or a similar hydrocarbon or hydrocarbon mixture and should be present in sufficient quantity to produce a fluid mixture of the ferrite particles and liquid. The fatty acid can be oleic acid, although numerous other fatty acids as are known in the art, can be utilized to render the ferrite surfaces organophilac—with sufficient of the acid being present to produce the desired surface characteristics. The above organic liquid phase can be present as a single phase, or as a component of an emulsion with water which is stable at ambient temperature. Where the latter, sufficient of the organic liquid should be present to produce the said stable emulsion.

The magnetic ferrite utilized in the seeding systems preferably comprises ferroso-ferric oxide particles, which may be prepared as described in the aforementioned U.S. Pat. Nos. 4,087,004, and 4,125,460. In the procedure set forth in said patents, a particulate of the said ferroso-ferric oxide is prepared as a product of aqueous coprecipitation of iron (III) with iron (II) salts, by an excess of a relatively strong base. For present purposes, the resulting precipitate may be extracted into the organic liquid/fatty acid phase or left in aqueous phase with addition of a stabilizing fatty acid such as the dodecanoic acid mentioned above. The precipitate can be washed or unwashed in either event.

In addition to the mentioned ferroso-ferric oxide, other finely divided ferrimagnetic materials may be used in the invention, including cubic ferrites such as $NiFe_2O_4$ and $CoFe_2O_4$; gamma-ferric oxide; and more generally, the magnetic ferrites represented by the general formula $MO.Fe_2O_3$, where M is a divalent metal ion such as Mn, Mi, Fe, Co, Mg, etc.

The magnetic seeding system is added to the clay slurry in quantities of at least 0.2 lbs. expressed as $Fe_3O_4$, per ton of dry clay, with from 1 to 2 lbs/ton dry clay being preferred. As excess ferrite seed is removed by flotation, as well as by magnetic separation, overdosing does not detrimentally affect the clay brightness. Thus although there is in principle no objection to higher dosage rates for the seed, economics dictate use of the smallest dose as will produce a desired product brightness.

The magnetic field to which the slurry is subjected during the magnetic separation step, may in practice of the invention be reduced to as low as 0.5 kilogauss—and yet provide brightening of the treated mineral to acceptacle levels. In general, retention times in the field are adjusted to the field intensities utilized and to the brightening required. Utilizing field intensities in a typical operational range of from about 5 to 10 kilogauss, typical retention times in practice of the present invention are of the order of 15 to 80 seconds. Within the limits of the technology (and of economics) higher fields may also be used with the invention, e.g., up to 60 kilogauss or higher.

While not all aspects of the mechanism of the present invention are fully understood, and while applicants are not bound by any particular hypothesis, it is presently believed that as a result of the conditioning of the clay slurry with the fatty acid collecting agent, and of the subsequent seeding with a system of sub-micron sized magnetic ferrite particles the surfaces of which have been rendered hydrophobic, the subsequent mixing effects a high degree of coalescence between hydrophic-surfaced discolorants and the hydrophobic-surfaced seeding particles. Futher, the common hydrophobicity of seed particles tends to coalesce excess seed particles with other excess seed particles. To be noted is that the phenomenom of this invention is fundamentally different from the spontaneous seed-discolorant association which occurs in the processes of the Nott et al patents. In the latter instances, the surfaces of the discolorants in the clay slurry are much more active, having not been coated with oleic or other fatty acids.

Thus, when the conditioned and seeded slurry is thereupon subjected to a froth flotation, not only are discolorants removed which would "normally" be removed by flotation, but in addition, some discolorant particles are removed which have become associated with seeding particles by coalescence, and futher, some seeding particles (which are floatable by virtue of their hydrophobic surface) are removed. A final element being removed is the excess fatty acid collecting agent, which would otherwise add highly undesirable properties to the clay slurry.

Hence, it will be evident that as a result of the steps thus far described, a hydrophobic coalescence has occurred, which coalescence has also produced discolorant-seed and seed-seed bodies, which are susceptible to removal by flotation and which have a high magnetic susceptability.

The flotation has removed particles which are ultimately sought to be separated, and which would otherwise create serious problems at the magnetic separator stage. In particular, the flotation has removed large quantities of discolorants, i.e., the larger discolorant particles and associated seed; and the flotation has removed excess seeding particles. All of these elements would otherwise be removed at the separator stage, whereat (especially the seed) would contribute to rapid fouling of the matrix.

The flotation has also removed the excess fatty acid collector, together with other floatable organics as may be present, thereby eliminating the fouling which such organics would otherwise cause at the separator stage.

Thereupon, in the final step of the instant process, the purified underflow from the flotation cell is provided to the magnetic separator, but the underflow as mentioned, is now free of many of those elements which would generate serious problems at the separator and otherwise impair the effective operation of same. Indeed, substantially what remains for removal at the magnetic field, are small discolorant particles, which have been coalesced with seed particles and perhaps with other discolorant particles to create entities of higher magnetic susceptibility than would otherwise be present. Accordingly, the magnetic separator can act with a new degree of efficiency, not only in that it is relieved of the burden of removing larger discolorant particles, the seed associated with such particles, and excess seed (all of which have already come out at the flotation and which would otherwise rapidly foul the magnetic matrix), but moreover, because of the enhanced magnetic susceptibility of the remaining discolorant particles.

Thus, it will be clear that the blunging and conditioning and flotation steps of the present method directly interact with and affect the subsequent magnetic separation step, to enable in totality, a synergistically integrated result which is not otherwise possible.

DESCRIPTION OF PREFERRED EMBODIMENTS

Figure 1:
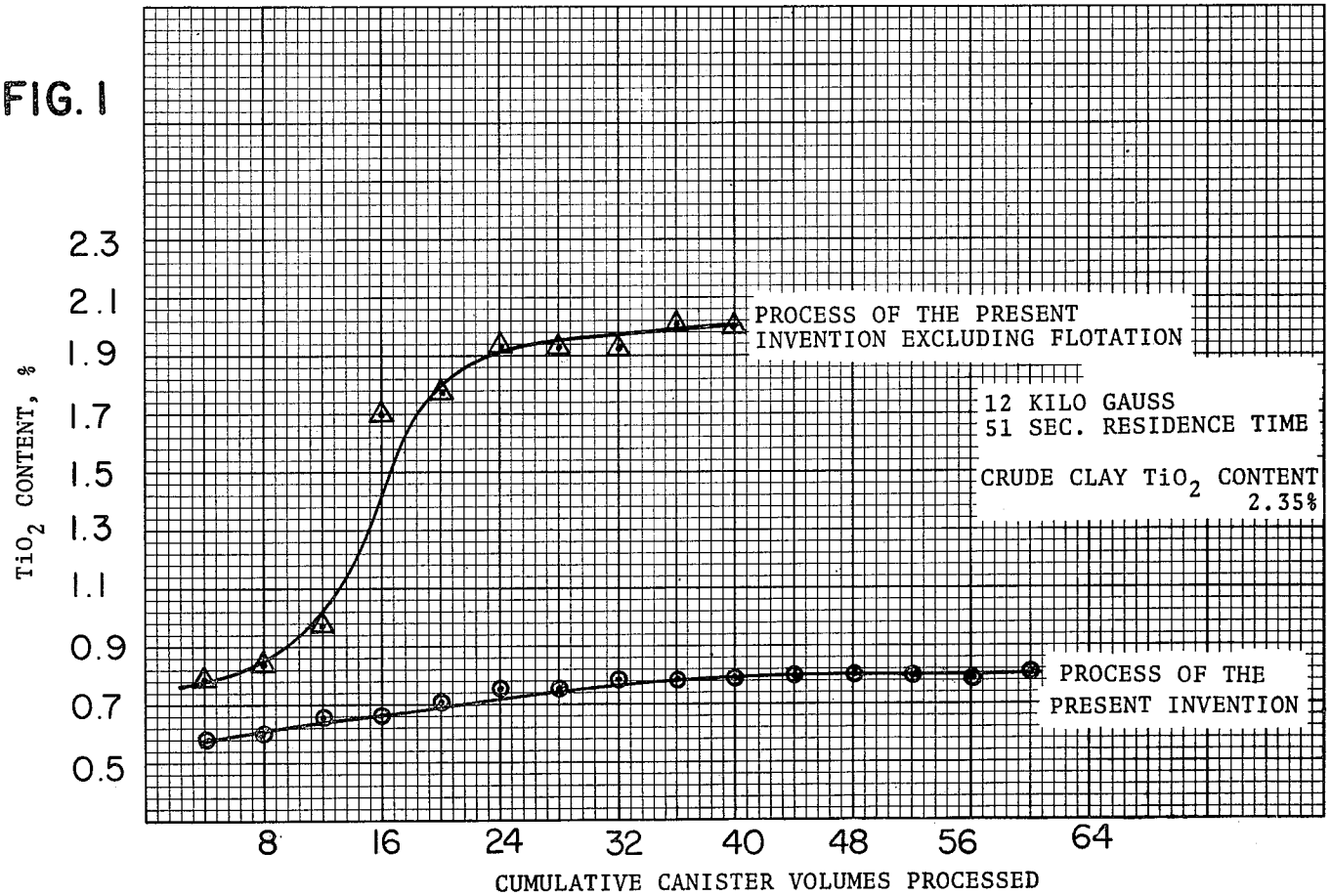
FIG. 1 is a graph plotting titania content as a function of cumulative volumes of clay beneficiated in a magnetic separator, for clay samples processed by the present invention, and by the identical process excluding only the flotation step.

The manner in which the present invention is practiced is best understood by consideration of the Examples now to be set forth, which further, will render clear to those familiar with the present art, the striking improvements achieved by the practice of the present methodology.

In Examples I through IX, three soft, cream Georgia kaolin clay samples were subjected to various beneficiation procedures, including the procedures of the present invention. In particular, each of the clays A, B, and C, were initially blunged. In each instance, an aqueous alkaline dispersion of the crude clay was formed, (pH adjusted to about 7 to 10 with ammonium hydroxide). The blunging was effected in the presence of a small amount of a dispersant, such as sodium silicate—and in the case of clay C, in the presence of a polyacrylate available under the tradename "Dispex N-40" from Allied Colloids of Great Britain.

In all instances in this specification it will be understood that brightness values were obtained according to the specification established by TAPPI procedure T646 os-75. Bleached brightness values were obtained by subjecting the samples to a conventional reductive bleaching treatment with sodium hydrosulfite at an addition level of 5.6 lbs/ton. Finally the $TiO_2$ content was determined by means of X-ray flourescence. The resulting data for all of Examples I through IX are set forth in Table I hereinbelow.

EXAMPLE I

The present Example was intended to provide one of a series of control Examples to demonstrate (by comparison) the efficacy of the present invention. The blunged slurries were thus diluted to 18% solids (by weight), and were screened, and then bleached. The indicated brightness and $TiO_2$ values thus represent controls for crude clay samples of the clays A, B, and C, which have been blunged, diluted, and screened, but not in other respects beneficiated.

EXAMPLE II

In this Example, intended to provide further control data, the procedures described in connection with Example I were again followed, except at the conclusion of screening the slurry was classified in a Bird centrifuge to recover a fraction wherein 92% by weight of the particulate material had an E.S.D. (equivalent spherical diameter) less than 2 microns. The size characteristics just indicated, and particle size characteristics as same may hereinafter be discussed in this specification, are as determined by Sedigraph analysis ("Sedigraph" is a trademark for size analysis instruments manufactured by Micromeritics Instrument Corp. of Norcross, Ga.). Resulting brightness and $TiO_2$ content data (for the said fraction), is set forth in Table I.

EXAMPLE III

In this Example, the same procedure was used as described in Example II, except that following blunging, dilution to 18% solids, and screening, the slurry was subjected to a magnetic separation by being passed through a canister containing a steel wool matrix (7.5% packing) in an apparatus of the general type described in the aforementioned Marston U.S. Pat. No. 3,627,678. The average field intensity during such treatment was about 12 kilogauss, and the retention time in the field was approximately 51 seconds. The data yielded is again tabulated in Table I hereinbelow, and may be regarded as representative of beneficiation of a clay slurry by conventional (non-seeded) high intensity magnetic separation.

EXAMPLE IV

In this instance, samples were processed as in Example II, except that the samples were seeded using a magnetic particulate of the type described in the prior art, more specifically of the type described in the aforementioned Alan J. Nott et al patents, including U.S. Pat. No. 4,087,004. This particulate thus comprised a synthesized ferroso-ferric oxide prepared by coprecipitating iron (III) and iron (II) ions from an aqueous solution in a desired molar ratio by contacting with an excess of a relatively strong base, i.e., ammonium hydroxide. The mode of preparation of such particulate is described in Example II of the aforementioned U.S. Pat. No. 4,087,004. This prior art aqueous particulate was utilized with the clay samples as taught in said U.S. Pat. No. 4,087,004. Ferroso-ferric oxide was added at the rate of 1.2 lbs/ton of dry clay. Thereupon the slurry was mixed to facilitate seeding, the seeded slurry was diluted to 18% solids and then passed through the magnetic separator under conditions identical to Example III. It was then classified to provide a 92% by weight less than 2 micron ESD fraction, which was subjected to the aforementioned testing procedures to determine bleached clay product brightness, and $TiO_2$ content. The data set forth in Table I, shows that quite excellent improvements in brightness, and reduction in titania content can be achieved by the procedure of this Example.

EXAMPLE V

It will be appreciated that thus far, all of the Examples set forth, specifically Examples I through IV, have utilized prior art techniques, and hence may all be regarded as control Examples, i.e., for providing comparative data for evaluating the present invention. In the instant Example, a procedure was utilized which is similar to that described in connection with Example IV, except in this instance the system of magnetic ferrite seeding particles was prepared by first utilizing the preparative procedures described in Example IV, i.e., by the same procedures as are referenced in the Nott et al U.S. Pat. No. 4,087,004 (see Example II of that patent). The aqueous magnetic particulate which results from the Nott et al procedure was, however (in correspondence to one aspect of the present invention), subjected to the further important step of particle size stabilization, by mixing the said magnetic particulate with approximately 0.017 lbs. of dodecanoic acid per lb. of ferroso-ferric oxide.

It may be pointed out in this connection that the use of dodecanoic acid, as well as of other fatty acids having carbon chain length of from about 10 to 15 carbon atoms, in connection with aqueous magnetic fluids, is not in its broadest sense first taught herein. Rather, reference may be made to the article, "Preparation of Dilution-Stable Aqueous Magnetic Fluids", by S. E. Khalafalla and George W. Reimers, appearing in IEEE TRANSACTIONS ON MAGNETICS VOL. MAG-16, No. 2, March, 1980. This article describes the use of dodecanoic acid and other fatty acids as mentioned, to produce an aqueous magnetic fluid which is stable toward dilution with water. It is, however, pointedly observed herein, that the said article considers exclusively "ferrofluids", i.e., homogeneous, completely stable magnetic fluids. In the present Example, i.e., in the magnetic ferrite particulate system used in this Example, the system is not a ferrofluid, as the system is actually not dispersed or peptized; indeed, the system above described is non-homogeneous, and upon standing, settles out into two components, one a relatively dark-colored phase including the ferroso-ferric oxide, and the other a clear aqueous phase. However, the dodecanoic acid, in any event, size stabilizes the magnetic ferrite particles, which is a most important aspect of the present process. In the process of the invention, the said dodecanoic acid or other fatty acid in the indicated carbon chain length, should be present in concentration of at least $6.7\times10-^{3}$ g-moles/lb of magnetic ferrite expressed as $Fe_3O_4$, with a typical concentration of the fatty acid being of the order of $3.8\times10-^{2}$ g-moles/lb. of the said ferrite (expressed as $Fe_3O_4$). The $6.7\times10-^{3}$ figure translates to about 0.003 lbs. of dodecanoic acid. It may be noted that much greater quantities of the fatty acid can be utilized in the seeding system as same will be removed during flotation; but in consideration of economics it is desirable to use the minimum quantity of fatty acid as is effective. It is also of interest to note that the quantities of fatty acid used in the present seeding system are far below the range which is recommended for use in the compositions taught in the aforementiond Reimers and Khalafalla article. Of further interest for purposes of the present invention, is that the described aqueous seeding systems are found to be stable for use over sustained periods; e.g., after a month's storage, they are found to perform just as well in the process of the invention (such as in Example IX below).

In the instant Example, and following the addition of the said seeding system, the resultant slurry was diluted once again to 18% solids by weight, screened, subjected to magnetic separation as aforementioned, and thereupon classified to produce for testing a fraction of clay, including 92% by weight of particles which are less than 2 microns ESD. The resulting data is again set forth in Table I hereinbelow. The data is of interest, in part in showing that this type of seeding system, when used in the prior art Nott et al process (of Example IV) is actually less effective than the seeding materials described in Nott et al (which are used in the above Example IV). Part of the explanation for this is thought to be that the dodecanoic acid has passivitated the surfaces of the magnetic ferrite particles, and thereby reduced the tendency to spontaneous seeding which occurs with the prior art particulates.

EXAMPLE VI

In the present Example (a further control), the procedure utilized differed from that described in Example V, in that persuant to a key aspect of the invention, the crude clay was blunged and then conditioned in the presence of a conventional fatty acid collecting agent i.e., oleic acid. The subsequent processing was identical to that described in connection with Example V. In studying the results set forth in Table I, it is seen that the bleached clay product brightness has been increased considerably by the present procedure, and of considerable further interest is the lowering of titania content. While it will be appreciated that a flotation step has not been utilized in the present Example, the cited improvements in brightness and titania levels tends to support the hypothesized mechanism of the present invention, i.e., as being one wherein hydrophobic coalescence occurs, facilitating removal of the coalesced materials by subsequent separation processes, which in this instance, includes only magnetic separation.

EXAMPLE VII

In this Example, the groups of clays A, B, and C, were subjected to a further control procedure, in this instance to conventional benefication by froth flotation. Such procedure is described as one aspect of Nott U.S. Pat. No. 3,974,067. In particular, in such sequence, the crude clay samples were blunged and conditioned in the presence of oleic acid as a collecting agent. The blunged and conditioned slurry, after addition of a frothing agent, was then subjected to a conventional treatment in a froth flotation cell, after which the beneficiated underflow was classified in a centrifuge to yield a 92% by weight less than 2 micron ESD fraction, which was subjected to the tests for brightness and titania content, as previously discussed. The resulting data is set forth in Table I, from which it will be seen that bleached clay product brightness and titania levels are not as good as those achieved with the seeding and magnetic separation processes called for in Examples IV, V, and VI.

EXAMPLE VIII

In this Example, which again constitutes a further control, for comparing and evaluating the results yielded by the present invention, the same series of clay specimens, i.e., of groups A, B, and C, were subjected to the combined flotation and magnetic separation procedure of the prior art, as same is disclosed in the Alan J. Nott U.S. Pat. No. 3,974,067, which has previously been referenced. The flotation procedure was as disclosed in Example VII; and following flotation the beneficiated output from the flotation cells were subjected to subsequent treatment in a high intensity magnetic field. The flotation-beneficiated slurry samples, after being diluted, as appropriate to include about 30% solids content, were passed through the magnetic separator of the aforementioned Marston type, wherein an approximate field intensity of about 15.5 kilogauss was maintained at the steel wool matrix. The flow rate of the slurry during the magnetic treatment was such that retention time in the magnetic field was approximately 1.2 minutes. The samples emerging from the magnetic separator were flocculated, bleached, and dewatered to yield test samples. The result of the said processes are once again set forth in Table I, from which it will be seen that very excellent brightness improvements were achieved, and titania levels were reduced well below those yielded by the flotation alone procedure of Example VII.

EXAMPLE IX

In the present Example, the process of the present invention was utilized to beneficiate the clay samples of groups A, B, and C. Thus, in the procedure utilized in this Example, the samples were first blunged together with oleic acid, as in Examples VI, VII, and VIII. A seeding system of the type described in Examples V and VI, which comprised ferroso-ferric oxide particles in an aqueous phase, together with 0.017 lbs. dodecanoic acid per lb. of ferroso-ferric oxide, was thereupon added to the blunged and conditioned clay slurry samples. The said seeding system was added to the slurries in quantities to yield 1.2 lb. expressed as $Fe_3O_4$ per ton of dry clay. Following this, the resulting seeded slurry was further mixed to coalesce the hydrophobic-surfaced discolorants with the hydrophobic-surfaced seeding particles. The resulting seeded slurries were then subjected to froth flotation as described in connection with Examples VII and VIII; and thereupon the beneficiated underflow was subjected to a magnetic separation by passing same through the aforementioned Marston-type separator utilizing a field intensity of about 12 kG and retention time of 51 seconds.

Thereupon, 92% less than 2 micron fractions of the beneficiated slurry samples were evaluated for bleached product brightness and titania content. The results are set forth in Table I, from whence it will be seen that brightnesses have been achieved well exceeding those obtained in any of the procedures described in the preceding Examples. Further, it will be seen that a remarkable reduction in titania content has been achieved. Clearly the results exceed all expectations yielded by the prior art procedures.

course, is in accordance with the present invention, and constitutes a preferred mode of operation persuant to same. The procedure in Example VI is similar to that of Example IX, with the important distinction that no flotation step is utilized. In each instance, the beneficiated clay slurries were passed through a magnetic separator of the Marston type at flow rates of approximately 800 ml/min, and at a field intensity of 12 kilogauss. The initial crude samples had a titania content of 2.35% by weight. The canister volumes in each instance were such that retention time in the field was approximately 51 seconds.

Utilizing the two procedures, specimens of the output from the magnetic separator were examined for titania content after a specified number of canister volumes had been successively processed. Thus, it was possible by this procedure to determine how the efficiency of the magnetic separator was being effected by the cumulative processing of samples. The results yielded are set forth in the graph of FIG. 1, from whence it will be apparent that by use of the process of the present invention, the titania content is not only reduced to far lower levels than by following a similar sequence but without the use of the synergistically related flotation step; but further, it will be evident that in the sequence of seeding and magnetic separation without the intermediate flotation, the magnetic separator rapidly loses its ability to remove the titania, this being a consequence of fouling of the matrix. On the contrary, however, and using the process of the present invention, it will be clear that the efficiency of removal remains at its extremely high level for a very extended period. Indeed, the efficiency remains fairly close to a constant value to the end of the graph, where 60 canister volumes have been cumulatively processed.

EXAMPLE XI

In the present Example, the same procedure as was

TABLE I

| CLAY A | | | CLAY B | | | CLAY C | | |
|---|---|---|---|---|---|---|---|---|
| Example | Bleached Clay Product Brightness | %$TiO_2$ | Example | Bleached Clay Product Brightness | %$TiO_2$ | Example | Bleached Clay Product Brightness | %$TiO_2$ |
| I | 83.5 | 3.24 | I | 84.7 | 1.4 | I | 85.7 | 1.47 |
| II | 83.5 | 3.24 | II | 84.8 | 1.4 | II | 86.8 | 1.28 |
| III | 85.7 | 2.67 | III | 88.7 | 1.28 | III | 89.8 | .90 |
| IV | 88.0 | 1.47 | IV | 91.0 | .52 | IV | 91.9 | .33 |
| V | 86.8 | 2.16 | V | 90.6 | .71 | V | 91.7 | .43 |
| VI | 87.1 | 1.78 | VI | 91.2 | .52 | VI | 92.3 | .33 |
| VII | 85.6 | 2.41 | VII | 88.7 | .75 | VII | 88.3 | .90 |
| VIII | 87.4 | 2.03 | VIII | 90.4 | .58 | VIII | 90.2 | .58 |
| IX | 90.7 | .84 | IX | 91.7 | .39 | IX | 92.4 | .20 |

EXAMPLE X

A most important and significant aspect of the present invention as previously discussed herein, is the fact that where the present process is utilized, the matrix material of the magnetic separator (which material commonly comprises steel wool as aforementioned) is not rapidly fouled and blinded, as occurs in prior art beneficiation of clays utilizing magnetic seeding techniques.

Figure 2:
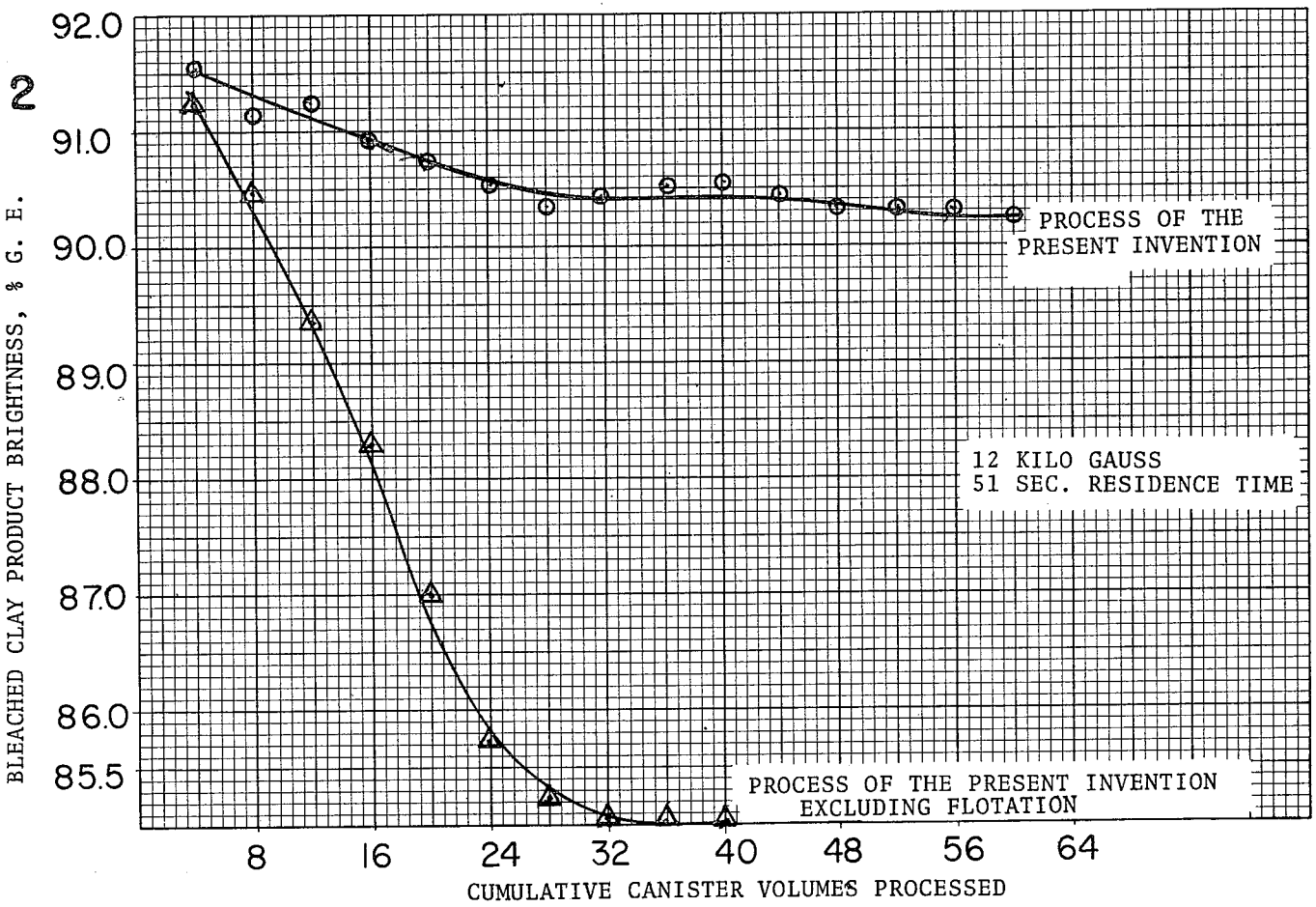
FIG. 2 is a graph plotting bleached clay product brightness for the samples processed as described for FIG. 1.

In the present Example, this aspect of the invention was illustrated by subjecting clay samples which consisted of approximately 50% by weight of the aforementioned clay A, and 50% by weight of the aforementioned clay C, to two types of beneficiation, namely to beneficiation sequences corresponding to those set forth in Example VI and in Example IX. Example IX, of described in connection with Example X was utilized, except in this instance, bleached brightnesses were determined as a function of cumulative flow through the canister of the magnetic separating apparatus. The results yielded by this procedure are set forth in the graph of FIG. 2, which is similar in nature to FIG. 1, except that bleached clay product brightnesses are plotted as ordinates against number of canister volumes which have been processed up to the abscissa at which the ordinate is plotted. Examination of the comparative curve (at lower left) for the data yielded by a procedure using a sequence which is substantially identical to the present invention, but which does not employ the intermediate flotation step following the blunging and conditioning with oleic acid and seeding, shows a rapid fouling of the matrix, whereby there is a rapid drop off in the brightness level of the processed clay samples. In marked contrast, the process of the present invention, which yields the results shown in the uppermost curve, shows but a very slow drop-off in brightness as the canister volumes are processed. The curve is indeed seen to be close to flat.

EXAMPLE XII

Figure 3:
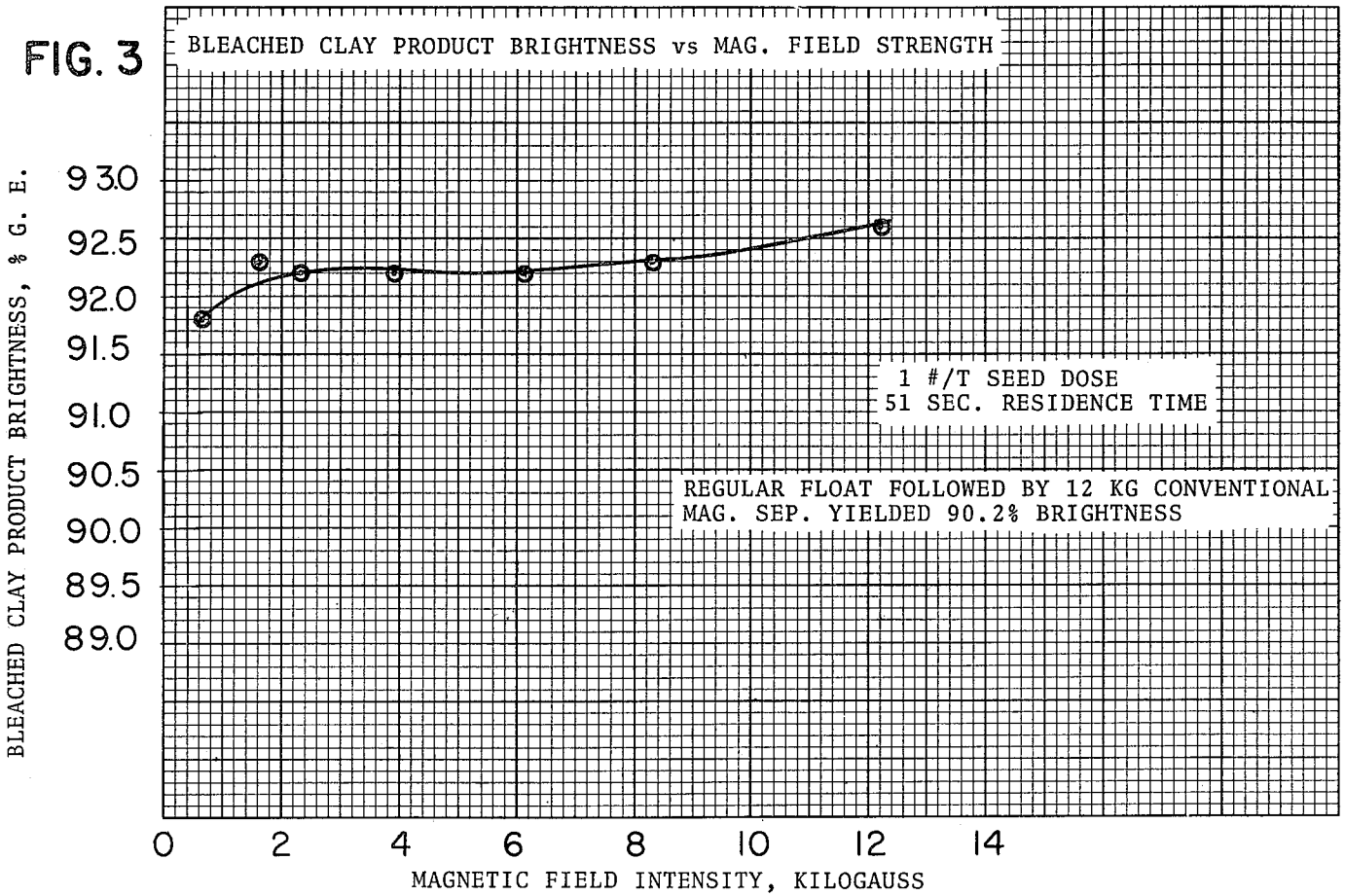
FIG. 3 is a graph plotting bleached clay product brightness as a function of applied magnetic field intensity, for clay samples beneficiated by the process of the present invention.

In order to demonstrate the effect of magnetic field intensity levels upon the process of the present invention, a group of samples of clay C were first beneficiated by prior art flotation, as in Example VII, and by the combined flotation and magnetic separation (at 12 kG) technique of Example VIII. These respectively yielded bleached product brightnesses of 88.3 and 90.2, which served as control values. Further such samples, were then subjected to the seeded flotation and magnetic separation process of the present invention, using the procedure set forth in Example IX. The quantity of the aqueous seeding system was such as to provide ferrite concentration of 1 lb. $Fe_3O_4$ equivalent per ton of dry clay, and the seeding system was otherwise identical to that utilized in Example IX. Flow rate through the magnetic separator during the magnetic separation step was 800 ml/min. corresponding to a residence time of 0.85 minutes (51 seconds) in the magnetic field. The said procedure was carried out utilizing a a sequence of clay samples which were processed at different field intensities at the magnetic separator. The beneficiated samples were then processed to determine bleached clay product brightness, and the resulting data is plotted in the graph of FIG. 3, which specifically plots bleached clay product brightnesses as a function of magnetic field intensity. From this it will be seen that even at the lowest intensity utilized, i.e., approximately 0.64 kilogauss, the process of the invention has yielded a bleached clay product brightness of approximately 91.8, which is very remarkable, especially considering that conventional flotation (normally regarded as a very efficient process) has yielded a brightness of 88.3 and even combined conventional flotation and magnetic separation, a brightness of 90.2. Further to be noted, is that there is remarkably little variation in the bleached brightness over the range of magnetic intensity studied.

EXAMPLE XIII

Figure 4:
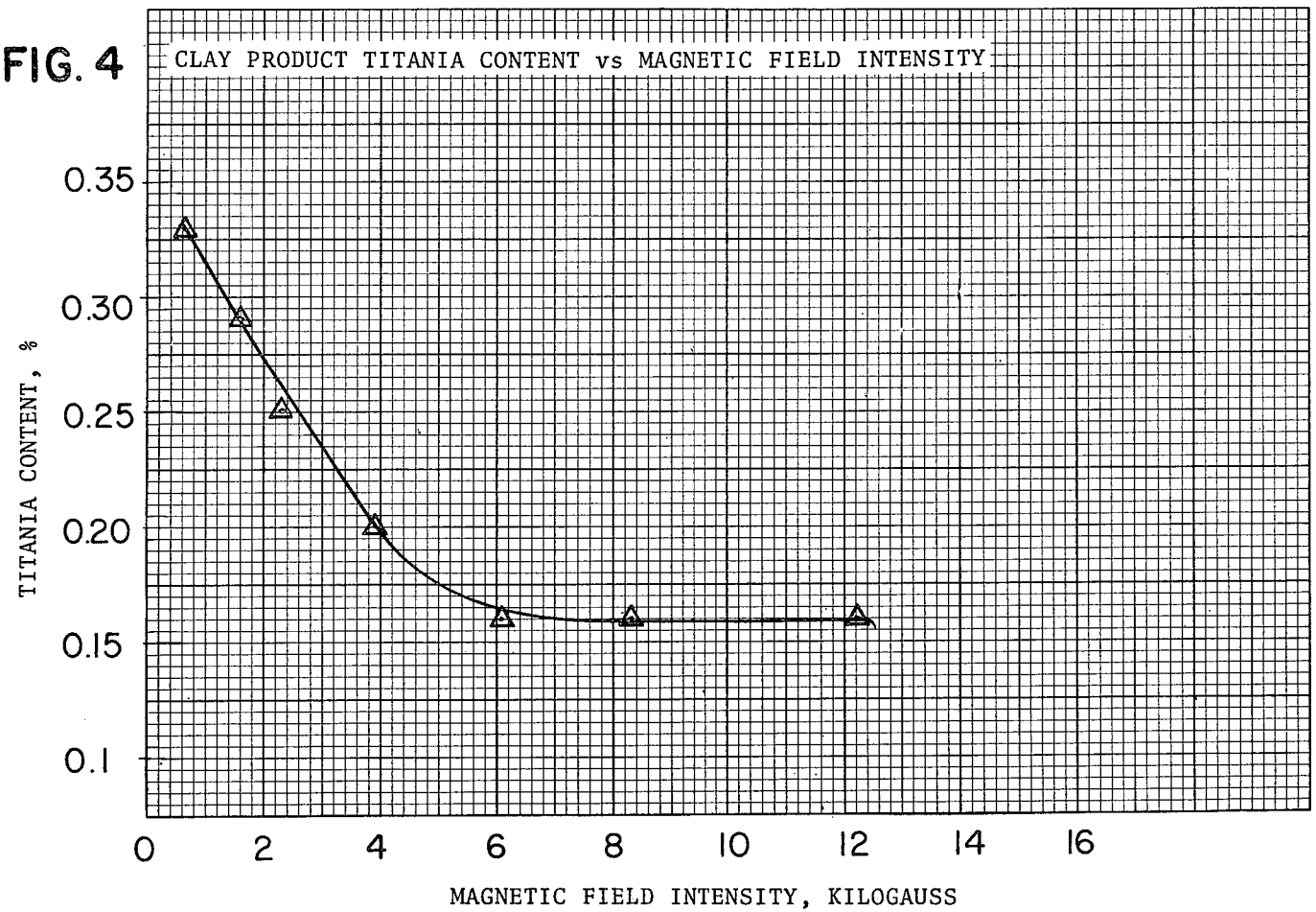
FIG. 4 is a graph plotting titania content for samples processed as described for FIG. 3.

In this Example, samples of clay C were subjected to the process of the invention as described in Example XII, and were then analyzed to determine the titania content thereof as a function of the applied magnetic field at the separator. The conventional flotation process in this instance, i.e., the conventional procedure of Example VII, had yielded an average titania content of 0.90% by weight for the samples. The results yielded by practice of the present invention are set forth in the graph of FIG. 4, which plots percentage titania (by weight) as a function of the intensity of the said field. It will be evident that the titania content has been remarkably reduced, especially in comparison to what is normally considered a very effective process in its own right, i.e., conventional flotation. It will also be seen that even at very low field values of approximately 0.6 kilogauss, the the process of the invention is still remarkably effective.

EXAMPLE XIV

Figure 5:
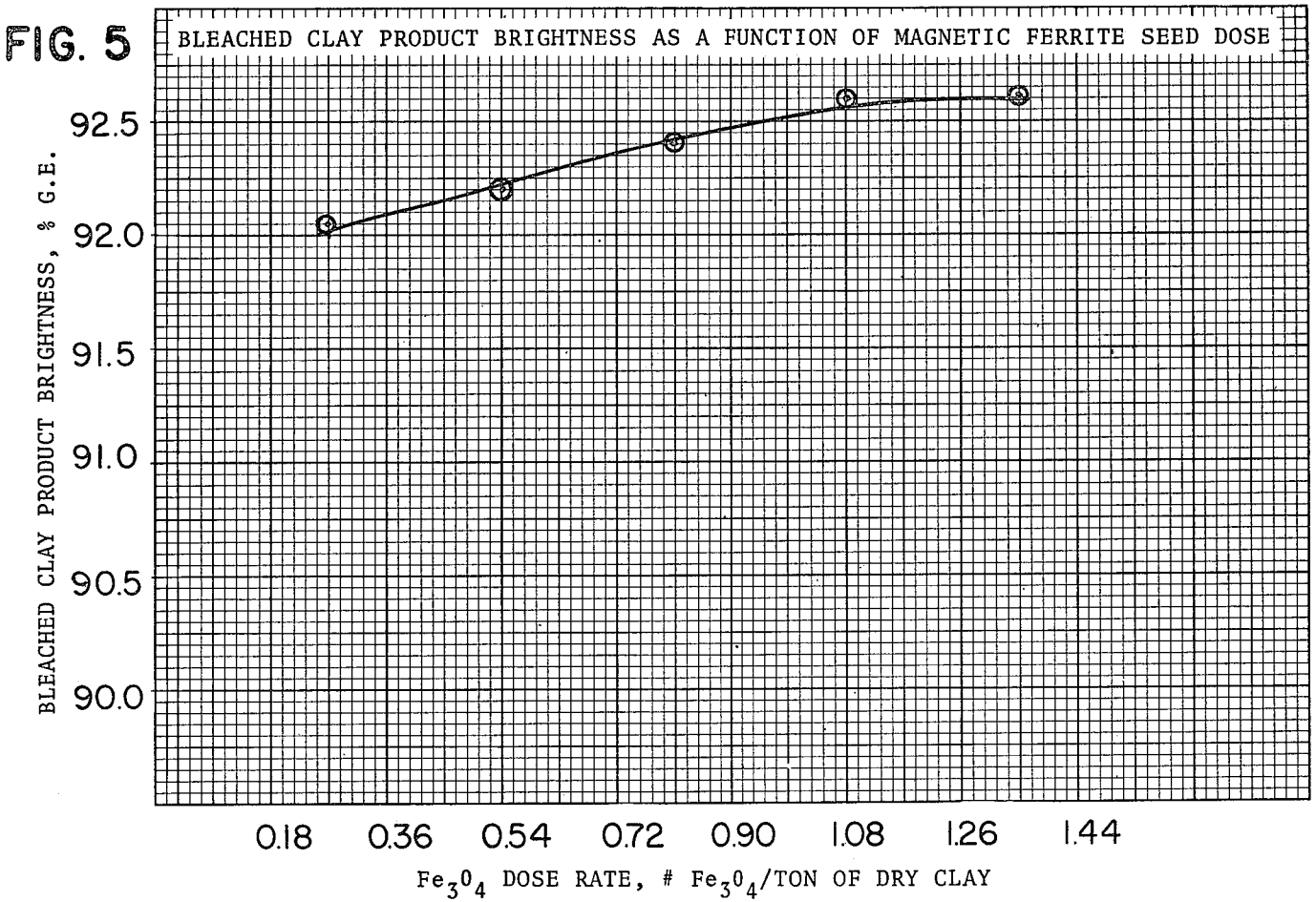
FIG. 5 is a graph plotting bleached clay product brightness as a function of the magnetic ferrite seed dose rate.

In this Example, the process of the present invention as exemplified by the procedure of Example IX, was carried out with a series of clay B samples, utilizing, however, various dosage levels for the aqueous magnetic seeding system. In order to again provide a control, the samples were subjected to a conventional flotation procedure as exemplified by the process described in Example VII. This yielded a bleached clay product brightness of 85.7. The samples were then subjected to the process of the invention utilizing a field intensity at the magnetic separator of 12 kG, and a 0.85 minutes residence time in the magnetic field. Bleached clay product brightnesses were determined as a function of concentration of the ferrite seed in the clay slurry. The results are set forth in the graph of FIG. 5, which represents bleached clay product brightness as a function of lbs/ton of dry clay of the ferrite expressed as $Fe_3O_4$. The depicted range for the curve is seen to run from about 0.27 lb/ton to 1.35 lb/ton— the curve is seen to be virtually flat over this range. The flattening out of the curve illustrates that there is little advantage in operating with seed concentrations exceeding the 1 to 2 lbs/ton previously mentioned.

EXAMPLE XV

In this Example the same procedures as were described in connection with Example XIII were followed, for the purposes, however, of determining the effect of concentration of the magnetic ferrite added by the seeding system upon titania content in the beneficiated samples. Again, for control purposes, evaluation of titania content was made of similar clay B samples which had been subjected to a conventional flotation treatment as described in connection with Example VII. This yielded a titania content of 0.75% by weight.

Figure 6:
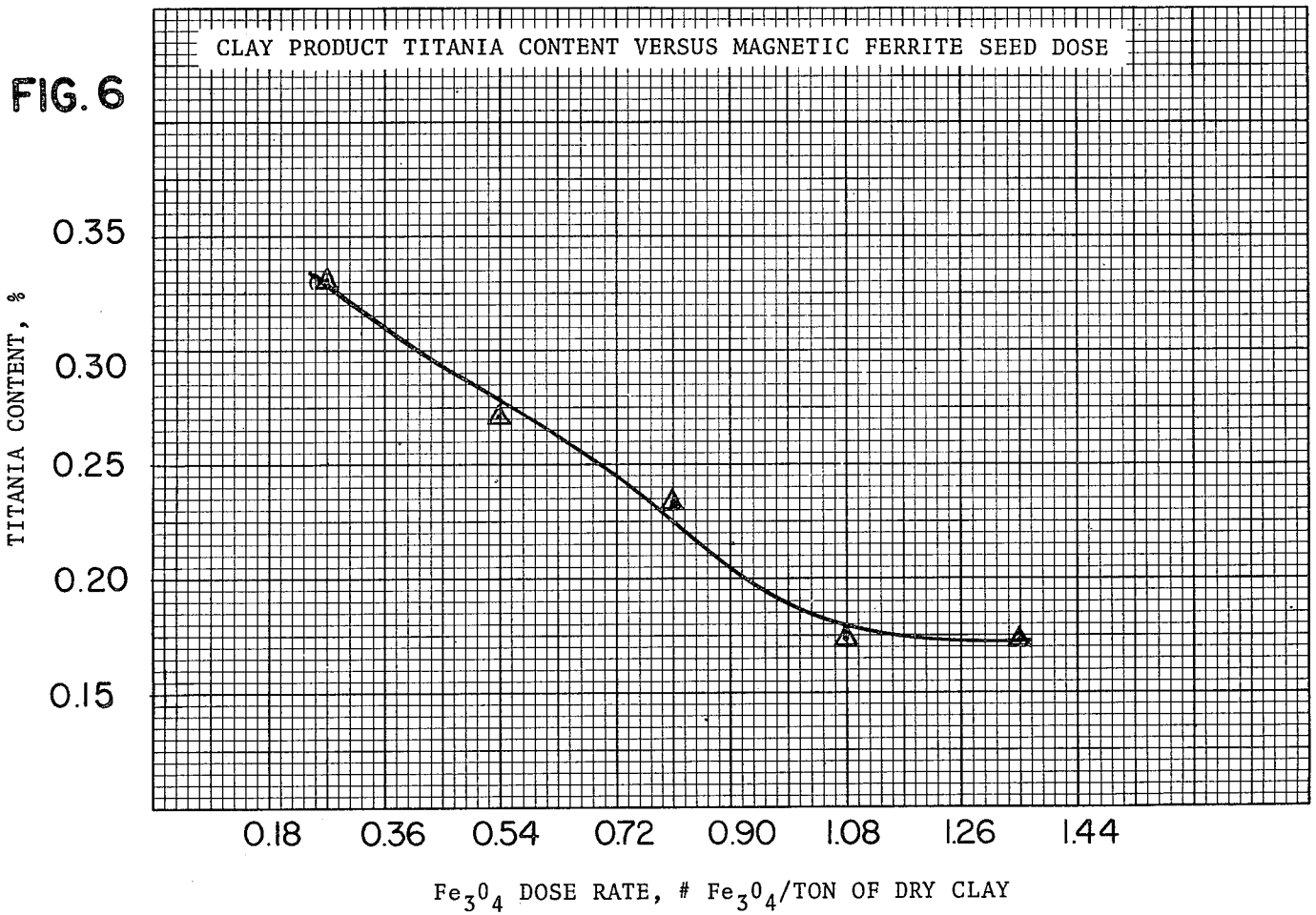
FIG. 6 is a graph plotting titania content for the samples processed as described for FIG. 5.

FIG. 6 plots the percentage of titania in the beneficiated samples for various dosage levels yielded in the slurry from addition of the seeding system. The abscissa values are identical to those in FIG. 4. To be noted again, is that the process of the invention is highly efficient over the entire range of data plotted, although the curve is not as flat as that of FIG. 5, suggesting that greater quantities of titania are removed at the somewhat higher seed concentrations.

EXAMPLE XVI

In this Example, the seeding system utilized was of the type set forth in Example IX, i.e., it constituted a system of magnetic ferrite particles in an aqueous phase together with a fatty acid containing from 10 to 15 carbon atoms. The objective of the Example was to demonstrate the effect of the fatty acid concentration on the bleached clay product brightnesses. In order to provide controls, a sample of clay A, was initially subjected to a conventional beneficiation by flotation as in the procedure of Example VII. This yielded a bleached clay product brightness of 85.6. Similar clay A samples were then subjected to the combined conventional flotation and magnetic separation treatment as in Example VIII. This yielded a bleached clay product brightness of 87.4. Thereupon, further samples of clay A were subjected to the process of the invention as in Example IX, with the fatty acid utilized in the seeding system being dodecanoic acid. The bleached brightnesses yielded in consequence of this procedure are set forth in Table II below.

TABLE II

| Dodecanoic Acid Concentration in lbs/lb of Magnetic Ferrite | Bleached Clay Product Brightness |
|---|---|
| .0025 | 87.9 |
| .005 | 88.1 |
| .01 | 88.5 |
| .0125 | 89.3 |
| .046 | 89.4 |
| .072 | 89.5 |
| .144 | 89.5 |

It is seen from the above Table that good results are yielded even with the fatty acid at the minimum tabularized concentration. In many representative applications of the process, the dodecanoic acid will be present in the seeding system at about 0.017 lbs/lb of the ferrite. It can be seen from the Table II, that at such level approximately the maximum brightness has been reached; i.e., as the quantity of dodecanoic acid is raised beyond this level, there is little further advantage to be gained in brightness improvements.

EXAMPLE XVII

In this Example, the procedure of the invention, i.e., as in Example IX utilizing a sequence of blunging and conditioning with a fatty acid collecting agent, followed by seeding, flotation, and magnetic separation, was again followed; except in this instance the seeding system utilized was not the aqueous system described in connection with Example IX. Rather, the seeding system of the present Example was prepared by first forming a ferroso-ferric oxide precipitate as in Example II of the Nott et al. U.S. Pat. No. 4,087,004, which material was admixed with a mixture of kerosene and oleic acid. This yielded a thick, creamy emulsion. The emulsion was added to clay slurry samples formed from a further soft cream Georia kaolin at an identical processing point as in the procedure of Example IX, and the seeding system was added in sufficient quantity to give the same concentration of magnetic ferrite with relationship to the dry clay in the slurry. Following flotation and classification, the samples were evaluated for brightness. This yielded a value of 91.3. Corresponding control brightnesses were determined for the same samples of clay when beneficiated by flotation alone, as in Example VII, and for the combined flotation and magnetic separation treatment as in Example VIII. This provided respective control brightnesses of 88.7 and 89.7.

EXAMPLE XVIII

The same procedure as described in connection with Example XVII was repeated, except in this instance, the seeding system, while initially prepared as in Example XVII, was admixed with more water and with sulfuric acid, in order to break the emulsion, and was thereupon heated to facilitate such breaking. This led to a separation into two layers, with the resulting system being used by first mixing the system so as to intermix the layers, and then adding the intermixed product to yield the desired concentrations of magnetic ferrite as aforesaid. It was found that bleached clay product brightnesses yielded were substantially identical to those found in Example XIX.

While the present invention has been particularly set forth in terms of specific embodiments thereof, it will be understood in view of the instant disclosure, that numerous variations upon the invention yet reside within the scope of the present teaching. Accordingly the invention is to be broadly construed, and limited only by the scope and spirit of the claims now appended hereto.

We claim:

1. A method for separating titaniferous and iron-containing discolorants from a crude kaolin clay, comprising the steps of:

forming a dispersed aqueous slurry of said clay, containing a deflocculant, and a fatty acid collecting agent; and conditioning said slurry to coat said discolorants with said collecting agent, to thereby render same hydrophobic;

adding to said slurry a system of sub-micron sized magnetic ferrite seeding particles, the surfaces of which have been rendered hydrophobic;

mixing said seeded slurry to coalesce said hydrophobic surfaced discolorants with said hydrophobic-surfaced seeding particles;

subjecting said seeded slurry to a froth flotation to remove substantial quantities of said discolorants and seeding particles coalesced therewith, and to remove excess seeding particles and coalesced seeding particles, and to remove excess of the fatty acid collecting agent; and subjecting the flotation-beneficiated clay slurry to a magnetic separation to remove further quantities of the discolorants and seeding particles associated therewith, and to remove seeding particles unassociated with said discolorants.

2. A method in accordance with claim 1, wherein said collecting agent comprises oleic acid.

3. A method in accordance with claim 1, wherein said magnetic separation is effected by passing said slurry through a porous ferromagnetic matrix positioned in a magnetic field having an intensity of at least 0.5 kilogauss.

4. A method in accordance with claim 1, wherein said slurry is seeded with at least 0.2 lbs. $Fe_3O_4$ molar equivalent of said magnetic ferrite per ton of dry clay.

5. A method in accordance with claim 4, wherein said magnetic ferrite comprises ferroso-ferric oxide.

6. A method in accordance with claim 1, wherein said seeding system comprises magnetic ferrite particles in an aqueous phase, together with a fatty acid containing from 10 to 15 carbon atoms, said acid rendering said ferrite particles hydrophobic and size-stabilizing same.

7. A method in accordance with claim 6, wherein said fatty acid comprises dodecanoic acid.

8. A method in accordance with claim 6, wherein said magnetic ferrite comprises ferroso-ferric oxide.

9. A method in accordance with claim 6, wherein said magnetic ferrite seeding system includes at least 0.003 lbs. of dodecanoic acid molar equivalent of fatty acid per lb. of magnetic ferrite expressed as $Fe_3O_4$.

10. A method in accordance with claim 1, wherein said seeding system comprises magnetic ferrite particles in an organic phase containing a fatty acid.

11. A method in accordance with claim 10, wherein said fatty acid is oleic acid, and wherein said organic liquid is kerosene.

12. A method in accordance with claim 10, wherein at least sufficient of said organic liquid is present to produce a fluid mixture of said ferrite particles and organic liquid.

13. A method in accordance with claim 10, wherein at least sufficient fatty acid is present to render the surfaces of said ferrite particles hydrophobic.

14. A method in accordance with claim 10, wherein said magnetic ferrite comprises ferroso-ferric oxide.

15. A method in accordance with claim 1, wherein said seeding system comprises magnetic ferrite particles in a stable emulsion of water and an organic liquid containing a fatty acid.

16. A method in accordance with claim 15, wherein said organic liquid comprises kerosene and said fatty acid comprises oleic acid.

17. A method in accordance with claim 15, wherein at least sufficient of said organic liquid is present to produce a stable emulsion at ambient temperature.

18. A method in accordance with claim 15, wherein at least sufficient fatty acid is present to render the surfaces of said ferrite particles hydrophobic.

19. A method in accordance with claim 15, wherein said magnetic ferrite comprises ferroso-ferric oxide.

* * * * *